US005595439A

United States Patent [19]

Maddock et al.

[11] Patent Number: 5,595,439

[45] Date of Patent: Jan. 21, 1997

[54] DECORATIVE LIGHT STRINGS AND MULTI-PURPOSE LAMPHOLDERS THEREFOR

[75] Inventors: William H. Maddock; David A. Parshad, both of Toronto, Canada

[73] Assignee: Noma Inc., Toronto, Canada

[21] Appl. No.: 318,397

[22] Filed: Oct. 5, 1994

Related U.S. Application Data

[63] Continuation-in-part of Ser. No. 49,335, Apr. 21, 1993, Pat. No. 5,355,288.

[51] Int. Cl.[6] ..... F21V 1/00

[52] U.S. Cl. ..... 362/238; 362/396; 362/806; 439/575

[58] Field of Search ..... 362/123, 396, 362/806, 122, 121, 249, 238, 250; 439/575, 574, 576; 248/221.4

[56] References Cited

U.S. PATENT DOCUMENTS

| | | | |
|---|---|---|---|
| Re. 28,710 | 2/1976 | Finkelstein | 439/575 |
| 2,183,377 | 12/1939 | Wolf | 439/575 |
| 3,678,443 | 7/1972 | Koehler | 439/575 |
| 5,021,706 | 6/1991 | Chen | 362/432 |
| 5,355,288 | 10/1994 | Maddock | 362/238 |

*Primary Examiner*—James C. Yeung
*Attorney, Agent, or Firm*—Kenneth M. Garrett

[57] ABSTRACT

A lampholder for decorative strings of lights comprises at least two clips, one of which is radially oriented, the other of which is axially oriented, the axially oriented clip being formed as an extension of the radially oriented clip. Preferably a second axially oriented clip is provided in diametrically and axially opposed relationship to the first axial clip. The clips permit the lampholders to be secured to widely different types of supports that may be adventitiously found in a dwelling structure or that may be easily provided and attached thereto, and in different orientations, thereby facilitating the decoration of the dwelling. Suitably and preferably the clips are integrally molded with the body of the lampholder.

10 Claims, 4 Drawing Sheets

DECORATIVE LIGHT STRINGS AND MULTI-PURPOSE LAMPHOLDERS THEREFOR

RELATED APPLICATIONS

This invention is a continuation in part of application Ser. No. 08/049,335 filed Apr. 21, 1993, now U.S. Pat. No. 5,355,288 commonly assigned herewith.

FIELD OF INVENTION

This invention relates to improvements to lampholders that may form part of a decorative string of lights such as are commonly used for decorating residential dwellings for festive occasions. It particularly relates to improvements for supporting the lampholders adjacent to the eaves of the dwelling without necessitating any structure for their support other than that commonly associated with the building structure or which is cheaply and easily obtained and applied thereto.

BACKGROUND OF INVENTION

Decorative light strings, as that term is used herein, comprise a plurality of lampholders connected together in a flexible string. The lampholders comprise a hollow insulating body portion within which the base of a lamp is retained. One such exemplary lampholder and lightstring is disclosed in U.S. Pat. No. 4,778,409, of common ownership herewith, the contents of which is incorporated herein by reference thereto.

Various means have been proposed for retaining the lampholders on supporting structure, exemplary of which are the following U.S. patents:

| | |
|---|---|
| 2,057,078 | Abramson |
| 2,259,733 | Benander |
| 2,889,451 | Longo |
| 3,291,428 | Sisalak |
| 3,341,699 | Somermeyer |
| 3,678,443 | Koehler |
| 3,883,926 | Reynolds |
| 5,021,706 | Chen |

One prior art approach to the problem of retaining lampholders on a supporting structure, as exemplified by Longo, is to use specifically matable elements, one of which is attached to or integrated with the lampholder, the other of which is secured to the supporting structure at conveniently spaced apart intervals.

A second prior an approach is to provide lampholders with a more or less general purpose clip means which can be used to engage with and grasp support structures of low specificity. Examples of this can be found in Koehler, commonly owned herewith, wherein the clip means is formed by a pair of jaws which will grasp elongated rod like structures, and in Reynolds, wherein the jaws are adapted to grasp rafters and roof boards adjacent to eaves of a dwelling.

Given that the lampholders are normally formed into light strings with up to about fifty lights, and that several of such strings may be employed to decorate a building, the need to provide the lampholders with the capability of grasping a wide range of supports is desirable, particularly where those supports are those that are commonly associated with the building structure, or where they may be supplemented by cheap, ubiquitous supports that are easily installed onto the building structure. It is also desirable that the lampholders be attachable whereby they can be oriented for maximum safety and effect, with the lamps possibly upwardly or downwardly oriented or horizontally oriented.

It is still further desirable that the improvements to the lampholders not substantially increase their cost.

It is an object of this invention to provide in lampholders and light strings clip means which is adapted to grasp and secure to widely different types of adventitious supports and semi-specific supports to facilitate the installation of the light strings onto buildings.

It is another object of this invention to provide in lampholders and light strings clip means that facilitate the installation of light strings with the lights thereof in a desirable orientation.

It is still another object of the invention to provide lampholders and light strings with improved clip means that are economic to produce and which are robust and easily installed.

SUMMARY OF THE INVENTION

In the above mentioned copending application there is disclosed lampholders and light strings incorporating such lampholders which include a clip means which may grasp elongated rod like elements and which is adapted to grasp point elements such as screw heads which may be disposed at desirable intervals on a building to be decorated. The lampholders are defined by a hollow insulating body portion having an opening thereto into which the base of a lamp is insertable for connection to the lampholder and a bottom wall in axially spaced apart relationally to the opening. A first clip means as defined in the foregoing application comprises first and second jaws rooted to the insulating body portion, preferably adjacent to the bottom wall, to extend radially outwardly from the lampholder in mutually opposed, axially spaced apart relationship, one of the jaws at least having a recess in medial portions thereof to facilitate locating and grasping a screw head. The jaws are relatively short and stiffly resilient, and are unsuited to grasping thick support structure. In accordance with the instant improvement, one of the jaws is provided adjacent its distal end with a jaw extension, which extension extends in a generally axial direction to terminate proximate the insulating body, to form a second clip means. It will be appreciated that the second clip means is inherently more resilient than the first clip means and that it can serve to grasp structures of a substantially thicker nature than those graspable by the first clip means; additionally, the manner in which structures are engagable with the first and second clip means will differ substantially, the first clip means generally being engagable with the support structure in a radial direction, and the second clip means in an axial direction. Accordingly the first clip means may be referred to as a radial clip means and the second clip means as an axial clip means, the two clip means permitting widely different support structures such as roof shingle edges, eavestrough edges, roof board edges, elongated rod like structures and screw heads to be variously graspable, usually with the option of the lampholder being oriented in a desirable manner.

Suitably and preferably the improved lampholder of the invention includes a third jaw disposed and the lampholder body extend in generally diametrically opposed relationship to the first and second jaws and in a generally axial direction opposed to the jaw extension of the second clip means, to form a third clip means, which from the foregoing description will be understood to form an axial clip means. Desirably the third clip means will have a resiliency differing from, and preferably intermediate to that of the first and second clip means, so as to be suited for grasping still other types of structures and thereby facilitate the installation of the light strings onto a building.

Suitably and preferably, the entrance to each of the clip means will have a profile to assist the engagement of the clip means with an object to be grasped and to enhance the grasping action.

The invention together with other objects and advantages thereof will be further described from the following description of the preferred embodiment.

BRIEF DESCRIPTION OF THE DRAWINGS In the drawings

DESCRIPTION OF THE PREFERRED EMBODIMENT

Figure 1:
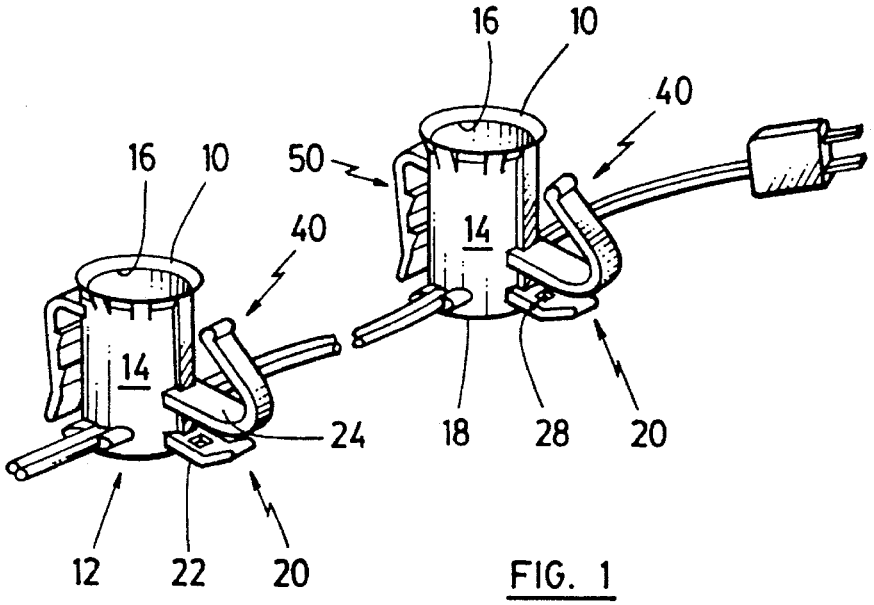
FIG. 1 shows in perspective view two lampholders in accordance with the invention, which lampholders form fragments of a decorative string of lights.
Figure 2:
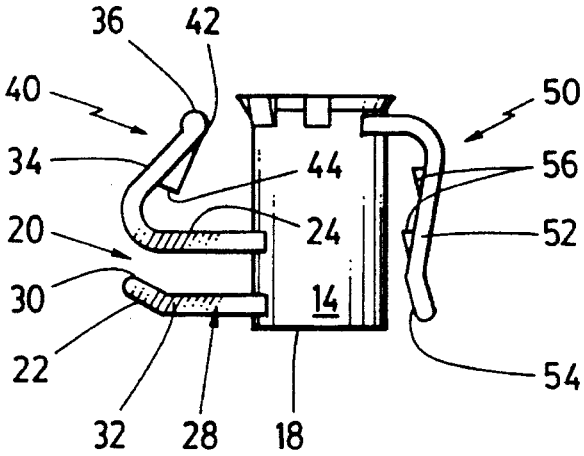
FIG. 2 shows in side elevation a lampholder of FIG. 1.
Figure 3:
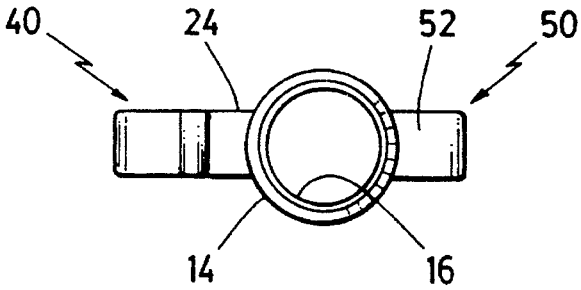
FIG. 3 shows in plan view from above the lampholder of FIG. 1.

Referring to the drawings in detail, a lampholder 10 forming part of a decorative string of lights 12 comprises a hollow insulating body 14, with an opening 16 thereto and a base 18 at axially opposed ends thereof. A radial clip means 20 is supported from body 14, which clip means comprises first and second jaws 22, 24 which extend radially outwardly from body 14 in mutually opposed, axially spaced apart relationship. The lower jaw 22 relative to base 18, is provided with a centrally disposed recess 28 therein which conveniently communicates with axially opposed sides of jaw 22. Jaws 22, 24 have a generally radially oriented entrance 30 therebetween disposed at the distal end of lower jaw 22, which jaw is inclined at 32 towards jaw 24 on approached to entrance 30 to provide a restriction adjacent to entrance, the entrance itself being rounded to facilitate the introduction of a support element into clip means 20 in a radial direction. The upper jaw 24 relative to base 18 is provided at its distal end with an upwardly turned jaw extension 34, the distal end 36 of which is disposed proximate body 14 remote from base 18, to form a first, axial clip means 40, end 36 being shaped to provide a generally axially disposed and rounded entrance 42 between body 14 and the jaw extension. The wall of jaw extension 34 on the inwardly facing side thereof is provided with a wedge-like tang appendage forming a shoulder 44 generally opposed to entrance 42.

A second axial clip means 50 is disposed on body 14 suitably in diametrically opposed relationship to jaws 22,24. Clip means 50 is formed by a jaw 52 conveniently rooted to body 14 adjacent opening 16 to extend in an opposed axial direction to jaw extension 34 to terminate adjacent base 18 and is shaped to provide at the distal end thereof a rounded axial entrance 54 between jaw 52 and body 14. A pair of small tangs 56 are provided on the inwardly facing surface of jaw 52.

The lampholder 10 of this embodiment is particularly adapted for moulding from thermoplastic materials whereby jaws 22, 24 and 52 and the jaw extension 34 are integrally formed with insulating body 14 to be resiliently deformable with a moderately high modulus of elasticity to provide a lampholder having particular use for gripping a wide range of support structures as will be further described.

Figure 4:
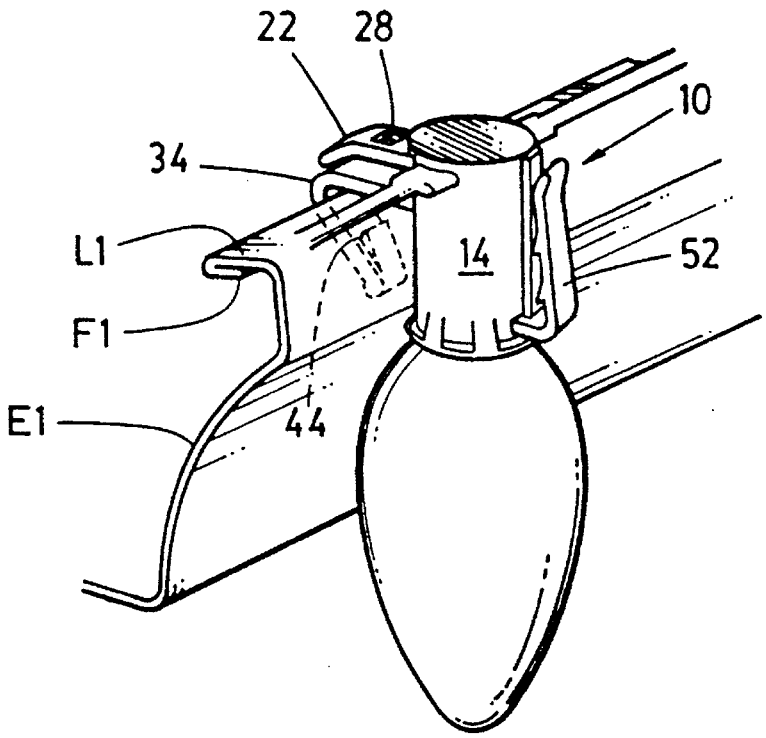
FIGS. 4–9 show the lampholder of FIG. 1 in perspective view in its different modes of attachment to building support structures.

Referring to FIG. 4, lampholder 10 is seen with the first axial clip means 40 in gripping relationship with a first eavestrough structure identified as E1, which is typically roll formed from sheet metal to provide a relatively deep lip L1 therealong. Lip L1 is received through axial entrance 42 of clip means 40 so as to be captured between jaw extension 34 and body 14, with shoulder 44 serving to abut the free edge F1 of lip L1 to assist in retaining lampholder 10 in a generally vertical position.

Figure 5:
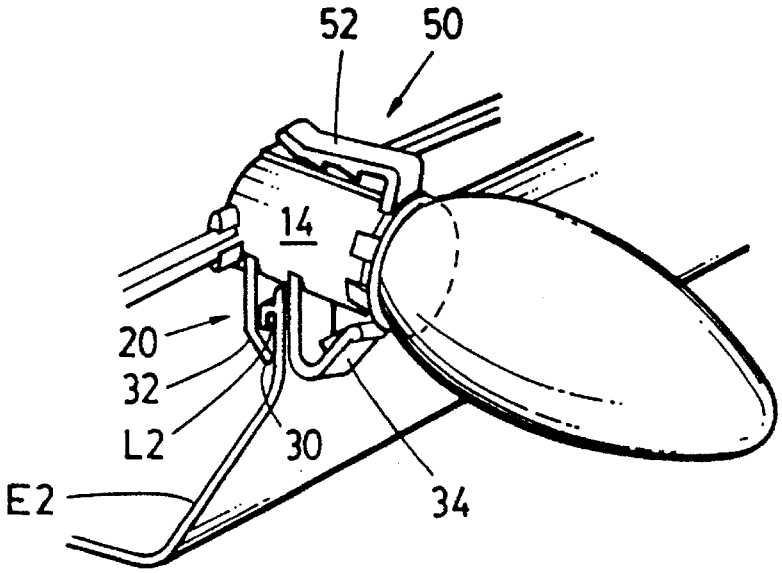

Referring now to FIG. 5, lampholder 10 is seen with radial clip means 20 in gripping relationship with a second eavestrough structure identified as E2, which may typically be of extruded plastic, having a relatively narrow lip L2 therealong. Lip L2 is received through radially oriented entrance 30 in gripping, captured relationship between jaws 22 and 24, with the upwardly inclined portion 32 of the lower jaw 22 co-acting with an edge F2 to assist in retaining lampholder 10 in a generally horizontal position.

Figure 6:
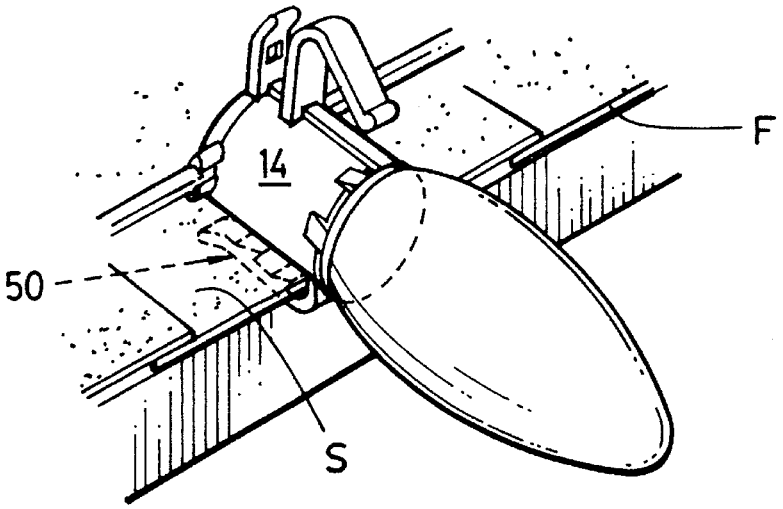

Referring now to FIG. 6, it is here assumed that the building to which a lampholder 10 is to be attached is devoid of eavestroughs. In this instance, second axial jaw 50 is utilized to capture onto and retain the free edge F3 of shingles S forming a part of the building structure.

Figure 7:
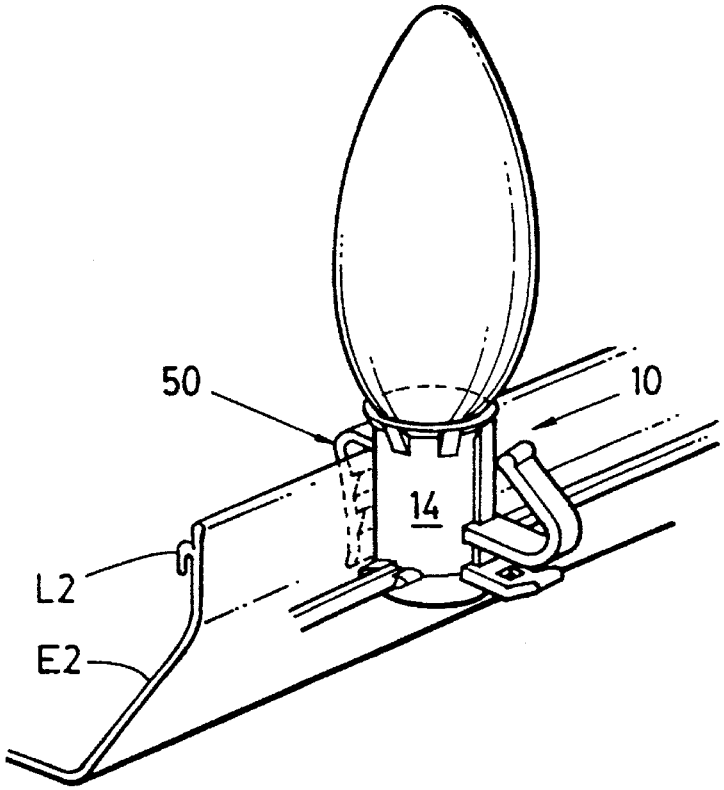
Figure 8:
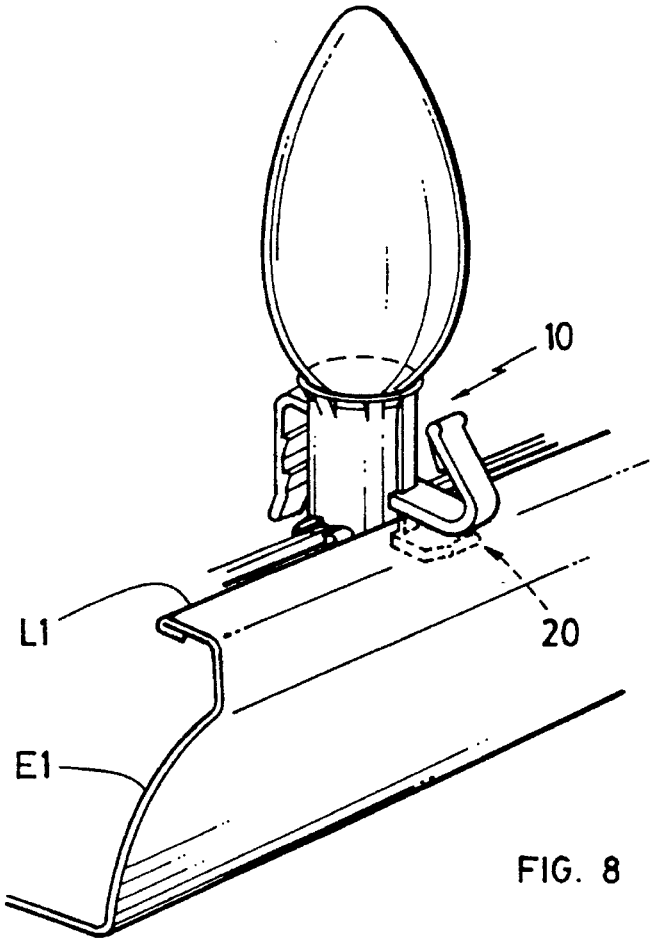

Referring now to FIG. 7, lampholder 10 is shown in mounted relationship on an eavestrough E2 having a section as earlier described in relation to FIG. 5, but wherein second axial clip 50 engages lip L2 to retain the lampholder in a vertically oriented upright position. In FIG. 8, lampholder 10 is also shown in vertically oriented upright position which is achieved by grasping lip L1 of an eavestrough of type E1 with radial clip means 20.

Figure 9:
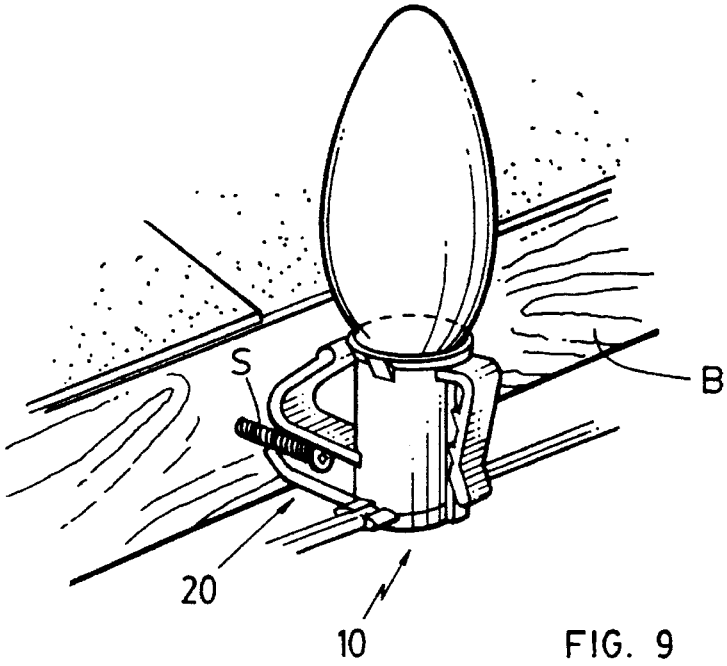

In FIG. 9, lampholder 10 is shown with radial clip means 20 grasping a screw S mounted in a convenient position on a gable end board B in a similar manner to that described in the previously mentioned patent application.

It will be appreciated that the above described embodiment and its manner of use are illustrative of the invention and its manner of use, and that many changes may be made thereto without departing from the spirit of the invention.

We claim:

1. A lampholder for a decorative string of lights; said lampholder comprising a hollow insulating body having an opening thereto through which the base of a lamp is insertable for retention in said lampholder, and a bottom wall, said opening and bottom wall defining axially opposed ends of said lampholder;

first radial clip means comprising first and second jaws extending radially outwardly from said body adjacent one of said axially opposed ends in mutually opposed, axially spaced apart relationship, said jaws having a generally radially disposed entrance therebetween;

said second jaw adjacent said entrance having a jaw extension which terminates proximate the other of said axially opposed ends of said lampholder to define a first axial clip means, said first axial clip means having a generally axially disposed entrance thereto;

said first radial clip means and said first axial clip means respectively serving to grasp different types of support structure and to permit said lampholder to be oriented in different manners with respect to said support structure.

2. A lampholder as defined in claim 1, wherein said first radial clip means is shaped adjacent said radially disposed entrance thereto to facilitate the engagement of said first radial clip means with a support in a radial direction.

3. A lampholder as defined in claim 1, wherein at least one of said first and second jaws is provided in medial portions thereof with a recess to adapt said jaws for gripping a headed support therebetween.

4. A lampholder as defined in claim 1, further comprising a third jaw rooted to said body in generally diametrically opposed relationship to said first and second jaws adjacent adjacent one of said axially opposed ends of said body to terminate at a distal end adjacent the other of said axially. opposed ends said second axial clip means having a shape different from that of said first axial clip means;

said second axial clip means serving to extend the nature of support structures to which said lampholder can be graspingly secured.

5. A lampholder as defined in claim 4, wherein said insulating body and each said clip means are unitarily molded from a thermoplastic material.

6. A decorative string of lights comprising a plurality of lampholders as defined in claim 4.

7. A lampholder as defined in claim 1, wherein said insulating body and each said clip means are unitarily molded from a thermoplastic material.

8. A lampholder as defined in claim 1 wherein said jaw extension is provided with a shoulder means adjacent the distal end thereof.

9. A lampholder as defined in claim 1 wherein said one of said axially opposed ends is adjacent to said bottom wall.

10. A decorative string of lights comprising a plurality of lampholders as defined in claim 1.

* * * * *